US005573191A

United States Patent [19]

Fuhr

[11] Patent Number: 5,573,191

[45] Date of Patent: Nov. 12, 1996

[54] DEVICE FOR THE EJECTION OF REMNANT PACKAGES AND EMPTY BOBBINS ON A CREEL

[75] Inventor: Martin Fuhr, Oberuzwil, Switzerland

[73] Assignee: Benninger AG, Uzwil, Switzerland

[21] Appl. No.: 305,308

[22] Filed: Sep. 15, 1994

[30] Foreign Application Priority Data

Nov. 10, 1993 [CH] Switzerland ..... 3381/93

[51] Int. Cl.[6] ..... B65H 67/02; D03J 5/08

[52] U.S. Cl. ..... 242/41; 242/35.5 A; 242/131.1

[58] Field of Search ..... 242/131.1, 131, 242/130, 41, 35.5 A; 414/331, 910; 198/487.1, 803.12, 482.1

[56] References Cited

U.S. PATENT DOCUMENTS 3,460,689 8/1969 Furst .

5,060,884 10/1991 Rapp .

*Primary Examiner*—Michael R. Mansen

*Attorney, Agent, or Firm*—Shoemaker and Mattare, Ltd.

[57] ABSTRACT

An impact element (12, 17), which is connected with a spring device (15), is tensioned through the feed movement of the package carrier rods (5) and, when a trigger position (23) is reached, will be released in such a way that a force impulse (I) is delivered in the direction of the nearest adjacent spindle (6), respectively a remnant package (2) or empty bobbin (3) mounted on said spindle. With that, the impact element transmits a force impulse, first of all onto a lossely mounted impact disc (19) which can be utilised with various bobbin formats and which protects the remnant packages.

12 Claims, 3 Drawing Sheets

DEVICE FOR THE EJECTION OF REMNANT PACKAGES AND EMPTY BOBBINS ON A CREEL

BACKGROUND OF THE INVENTION

The invention concerns a device for ejecting remnant packages and empty bobbins from a creel. Package changing on a sectional warping or beaming creel, involving the manual removal of incompletely used remnant packages and empty bobbins prior to reloading a set of packages, is intended to be simplified with this type of device.

The removal of remnant packages and empty bobbins with the aid of an ejection device is already known, with the package carrier tube being fed past the ejection device. A creel truck with vertical package carrier tubes has been made known in DE-A 17 10 169, for example, which can be slid through an ejection device. In that device, ejection arms are arranged at the heights of each row of packages, said ejection arms possessing a wedge-shaped sliding edge which engages behind the package bobbins. A disadvantage of this device, however, is that the force imparted onto the remnant package or empty bobbin gradually increases during the ejection procedure, and the spindle can jam because of the lever action. Apart from that, in the case of remnant packages, there is a danger of the yarn tangling with the ejection arm, or that the remnant winding will become damaged.

SUMMARY OF THE INVENTION

It is therefore a purpose of the invention to provide a device which avoids the known advantages and which also avoids damage to the remnant packages or tangling of the yarns. Additionally, the device must be useful with various package types, and should also permit a range of possible package sizes to be rejected.

Through prior tensioning of the impact element according to the invention, there will be no gradual imparting of force onto the remnant package or empty bobbins, as is the case with ejection methods according to the state of the art. Instead, the spring device serves as an energy accumulator which is gradually charged during the movement sequence of the package carrier device and which then releases its energy with a sharp impact onto the remnant packages and empty bobbins. The direction of this force impulse runs approximately parallel to the spindles so that they cannot assume an inclined position.

It is of particular advantage if the striking element is a striker arm with a radial spring, mounted on a holder. This type of striker arm does not need very great travel, so that depending on the length of the striker arm, tracking errors will be insignificant. Naturally, it is also conceivable for the striking element to be a plunger or a similar device lying transverse to the plane of movement of the package transport device and mounted to slide against the force of a pressure spring.

The holder for setting spring tension can with advantage be attached to the holding rod in various angular positions. In this way, the maximum desired tensioning force can be adjusted. Tensioning of the striker arm can be achieved in a particularly simple way if it is equipped with a cam, up against which the package carrier system runs, and if the shape of the said cam, in the trigger position, has a recess beyond its highest point in relation to its plane or planes of movement in order to trigger the impulse. The cam must obviously be arranged and dimensioned in such a way that it protrudes into the line of feed of the package carrier device when the spring device is in the released position. The cam profile rises, in the direction of movement, so that the striker arm is pressed back against the force of the spring device during tracking of the package carrier device, for example a package carrier tube. When the trigger position of a carrier tube is reached, the shape of the cam has an abrupt recess beyond its tip so that the striker arm rapidly returns. The tip of the cam thus forms the striking element which transmits the impact force impulse. The striker arm can, for example, take the form of a leaf spring onto which the cam is arranged on the package side.

Further advantages can be achieved if an impact disc is loosely arranged on each spindle, and if the impact disc can be impinged upon by the striking element, the force impulse being indirectly imparted onto the remnant package or empty bobbin. By providing of loosely attached impact discs, the risk of yarn or bobbin damage would be avoided. The size of the bobbin will no longer be significant since the impact disc will transmit the force impulse onto all bobbin dimensions. Positioning of the impact discs in relation to the package carrier tube will be automatically achieved when fitting of packages over the tube. As opposed to the remnant packages and empty bobbins, the impact discs are not ejected since their movement energy is relayed to the package bobbins, and at the most they will execute a swaying motion on the spindle after relaying of the force impulse.

Since the impact disc is impinged upon not at its center but rather at its edge area below the centre point of the spindle, its movement will be forwards, slightly lifted and inclined. The package bobbins will thus be slightly raised and ejected over the eccentric stopping disc at the head of each spindle. This slight lifting movement can be augmented by the geometry of the impact disc, particulary by a conical thickening of the impact disc from its centre outwards.

The package carrier device can be formed in a completely different way. It can possess vertical package carrier tubes which are attached to continuous, tensioned chains. With that arrangement, the impact elements can in each case be arranged close to the tensioned chain deflecting wheels which, in the transport direction, lie between the span of the chains corresponding to either the operating position or the change position.

The package carrier device can, however, also carry out a vertical movement of the set of packages, at the same time possessing horizontal package carrier tubes which are attached to a lateral, vertical, continuous, tensioned chain. Finally, the package carrier device could also be a travelling creel truck which is driven past an ejection station on which the striking element is arranged, in order to reach a change station.

BRIEF DESCRIPTION OF THE DRAWINGS

Further advantages and individual features of the invention will become evident from the following description of an embodiment, and from the drawings. Namely.

DESCRIPTION OF THE PREFERRED EMBODIMENT(S)

Figure 1:
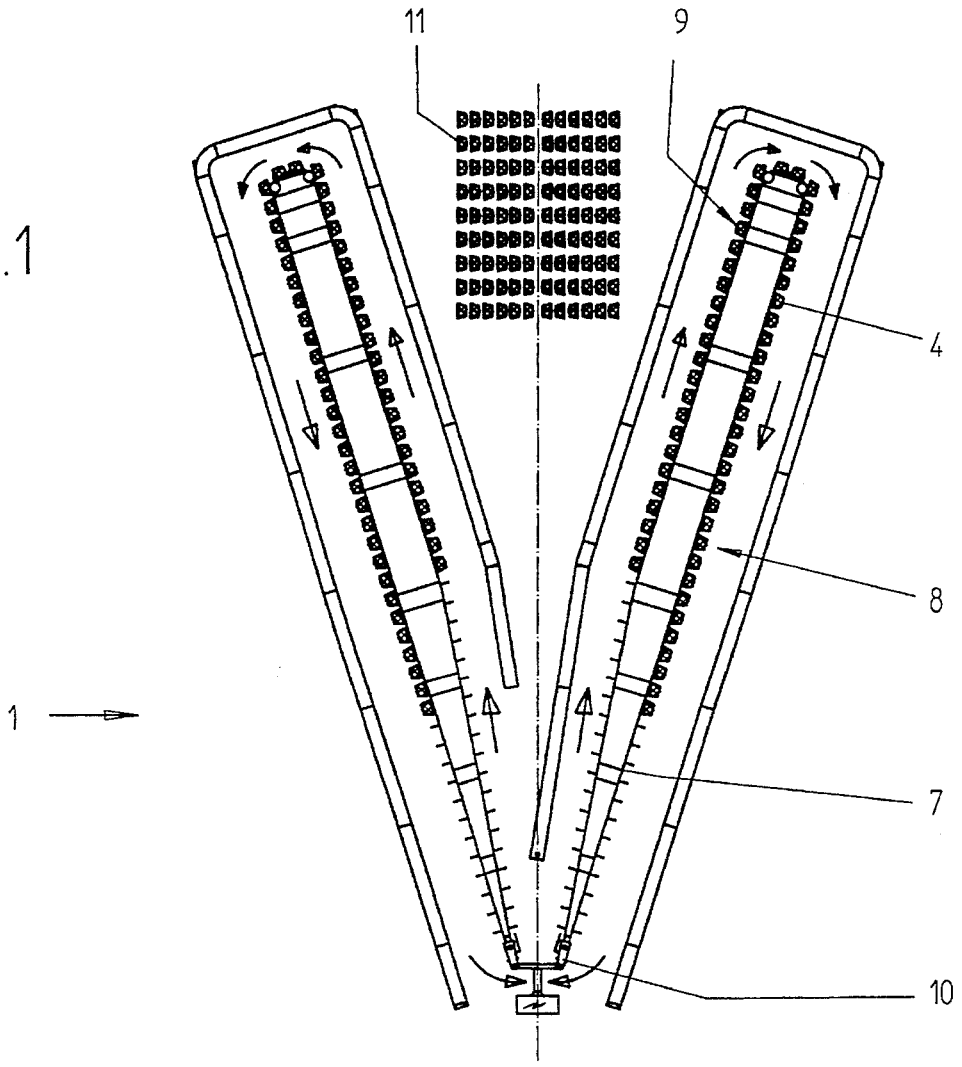
FIG. 1 is a schematic representation of a V creel with tensioned chain for the package carrier tubes.

FIG. 1 schematically shows the plan view of a basically known creel 1 of V-shaped layout. Each section of the creel is equipped with continuous, tensioned chains 7 on which the package carrier tubes 5 (FIG. 2) are arranged. The package carrier tube can, at the same time, be transported in the transport direction T from an operating position 8, from which the yarns are unwound, into a changing position 9, in which new packages 4 from a package store 11 are loaded. The ejection device according to the invention is located relatively near to the chain deflection wheels 10 which, seen in the direction of transport, lie between the operating position 8 and the change position 9 and divide the transport chain into each corresponding chain span. As the packages circulate from the change position 9 into the operating position 8, the remnant packages and empty bobbins will at the same time be transported to the change position 9, to be removed in the area of the deflection wheel 10.

Figure 2:
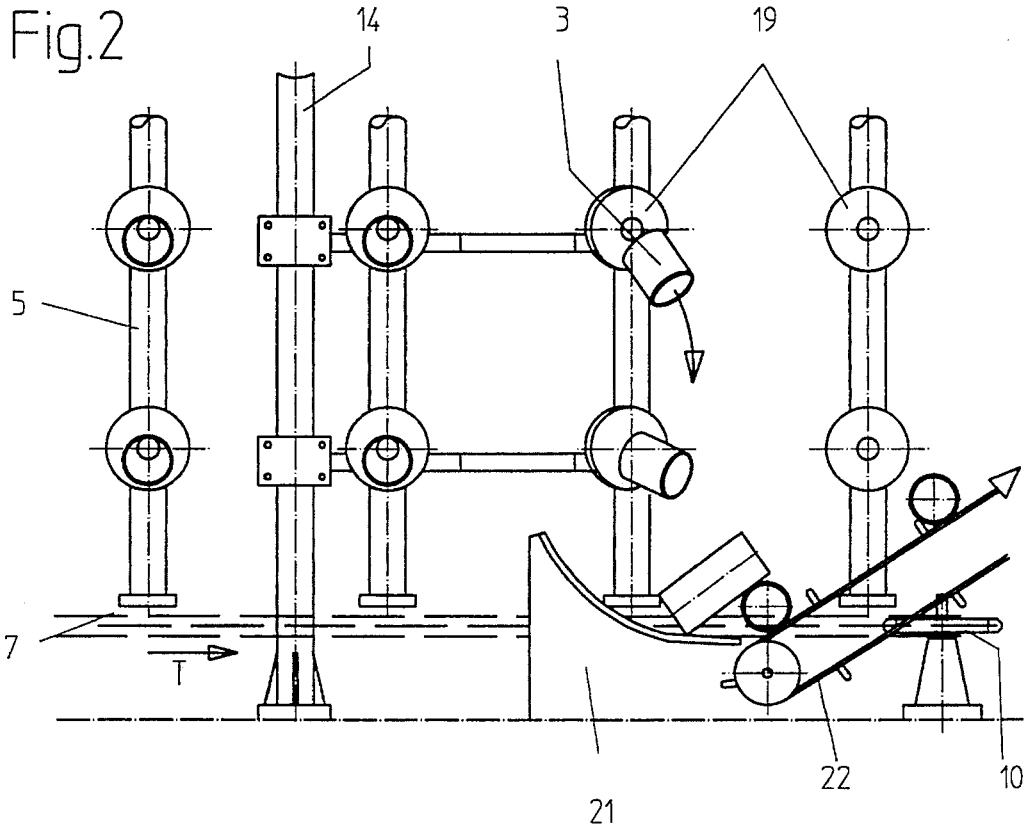
FIG. 2 is a side view of an ejection device according to the invention.
Figure 3:
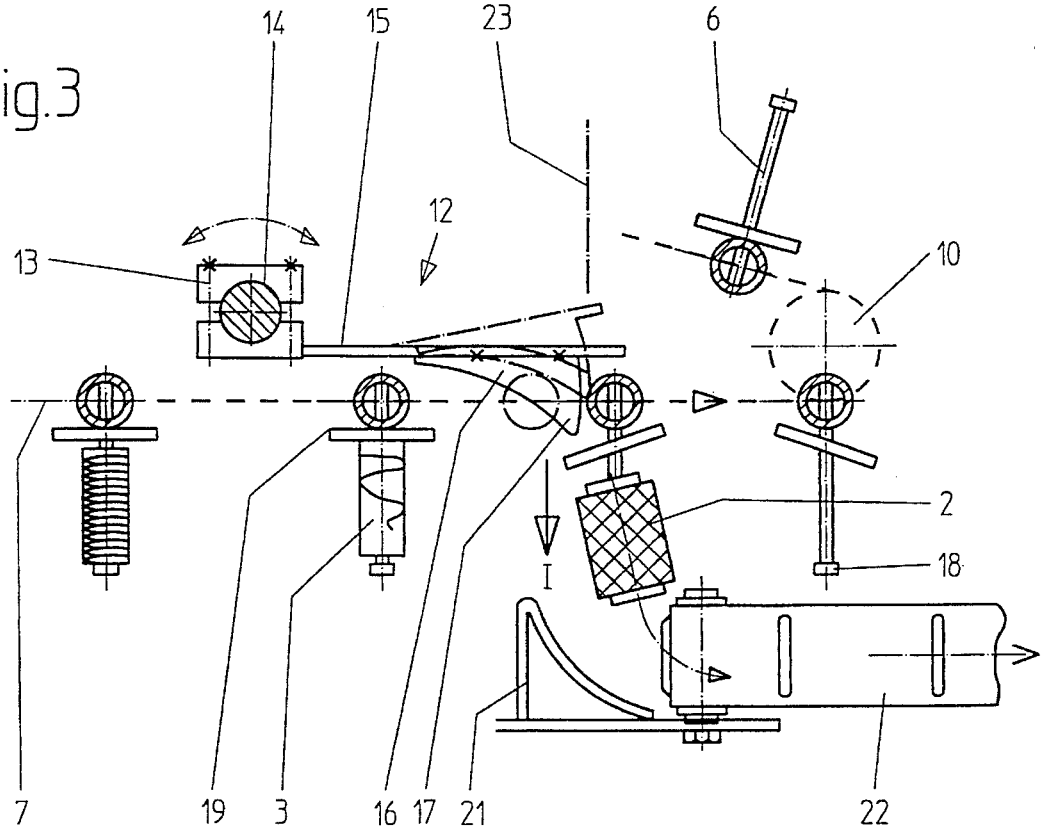
FIG. 3 is a plan view of the device according to FIG. 2.

In FIGS. 2 and 3, individual details of the ejection device are shown. So-called hooked spindles, on each end of which is an eccentric stopping disc 18, are arranged on the individual carrier tubes 5. The packages are loosely placed over the spindles and are held in place by the spindle stopping discs. In relation to the creel as a whole, the individual spindles form horizontal rows. A vertical holding rod 14 is arranged behind the set of packages, relatively close to the chain deflection wheels 10. For each row of spindles, a striker arm 12 is fastened with the aid of a holder 13 to this holding rod. The holder comprises, for example, two clamping pads which are placed under tension by means of screws. In this way, the holder can be rotated on the holding rod, and held firmly in various angular positions.

The striker arm 12 comprises a leaf spring 15 onto which a cam 16, for example of a plastic material, is mounted. The shape of this cam has an abrupt recess beyond its tip and, with a relaxed spring, will therefore protrude with its cam tip 17 into the area of movement of the package carrier tubes 5. The striker arm 12 is pressed rearwards when passing a package carrier tube, as suggested by the dotted lines. As soon as a package carrier tube has reached a trigger position 23, the cam tip 17 will strike in the direction of the adjacent spindle.

Figure 4:
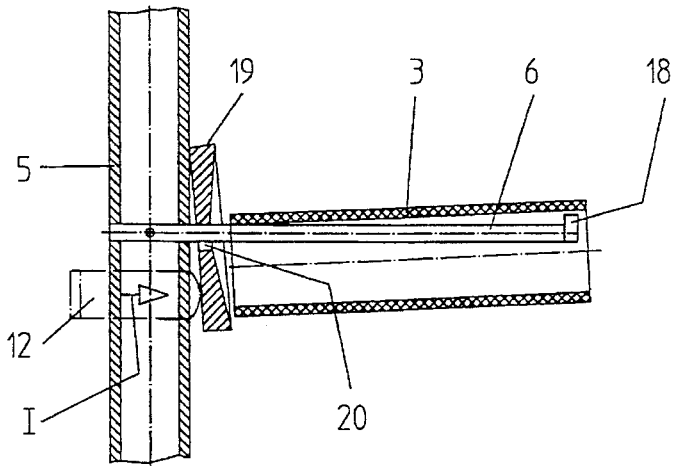
FIG. 4 is a cross section through a package carrier tube with spindle, and mounted impact disc.

An impact disc 19 is arranged between each of the package bobbins and the package carrier system 5. The cam tip 17 thus strikes the impact disc 19 and this in turn will relay the force impulse to the remnant package 2 or the empty bobbin 3. An impact disc 19, which conically thickens towards its outer edge, is shown in FIG. 4. The impact force impulse I, which impinges on the impact disc 19 below the spindle 6, causes the empty bobbin 3 to assume an inclined position, this movement being augmented by the conical shape of the impact disc. The empty bobbin 3 is thus lifted out over the spindle stopping disc 18 and is fully ejected from the spindle. With its residual energy, the impact disc 19 carries out a swaying movement on the spindle 6, but will then come to rest, at the latest up against the spindle stopping disc 18.

The ejection weight for the packages is able to be defined by means of adjustment of the maximum attainable spring tension, the spring tension being achieved by means of relative movement. In this way it is possible that only remnant packages with a minimal winding thickness are ejected. In contrast, new packages 4 will not not ejected so that when, for example, a creel section is wrongly loaded, recirculation of the set of packages without ejection of the packages is possible.

A retrieving device 21 is arranged in the area of the trigger position 23, thus in the position where the remnant packages and empty bobbins are ejected. This guides the empty bobbins and remnant packages directly onto a transport device 22., which for example comprises a conveyor belt leading to a container or similar device.

Figure 5:
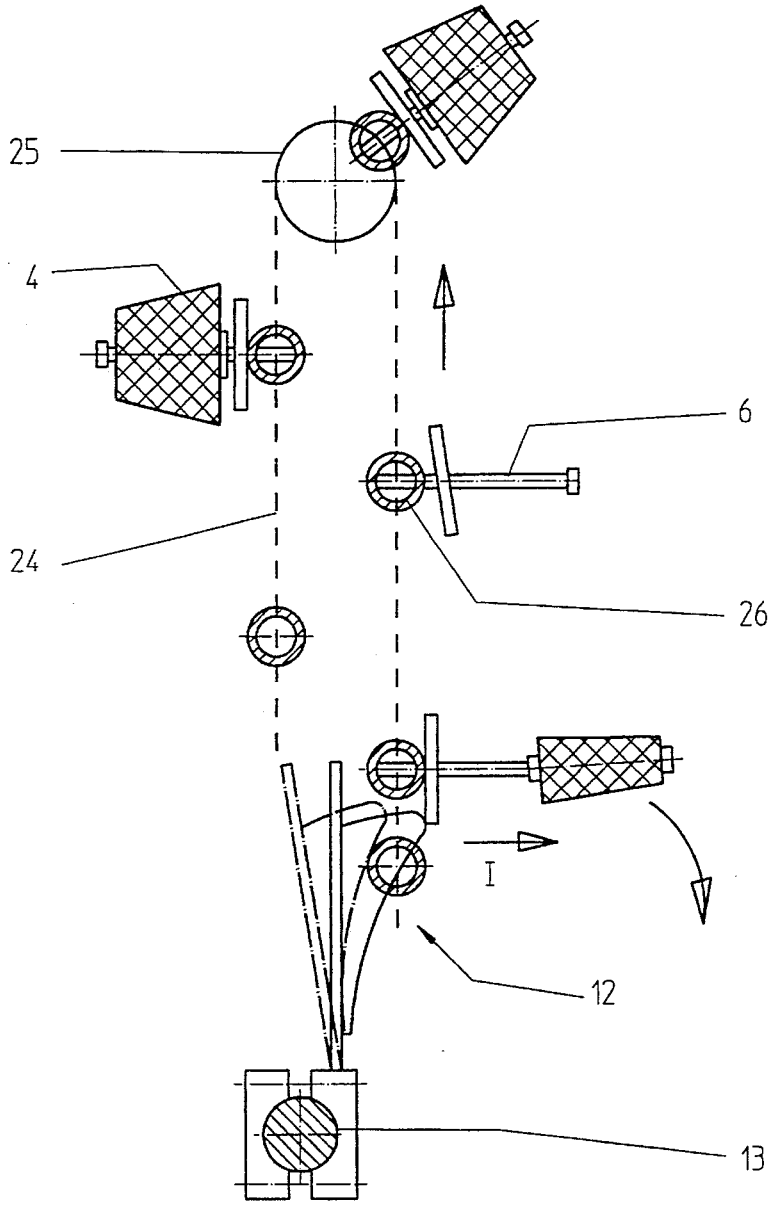
FIG. 5 is a schematic side view of a package carrier device with vertical movement of the set of packages.

FIG. 5 shows a schematic side view of a creel section with a vertical, circulating paternoster conveyor during package change. Here, horizontal package carrier tubes 26 are arranged on lateral paternoster chains 24, the chains being guided over lateral chain deflection wheels 25. It can be seen that the striker arm 12 runs in its holder 13 parallel to the chain, and thus vertically. Ejection of the remnant packages or package bobbins can take place directly above the lower chain deflecting wheel, which is not shown here, so that new packages can be loaded onto the spindles 6 on the upwardly travelling set of packages.

Figure 6:
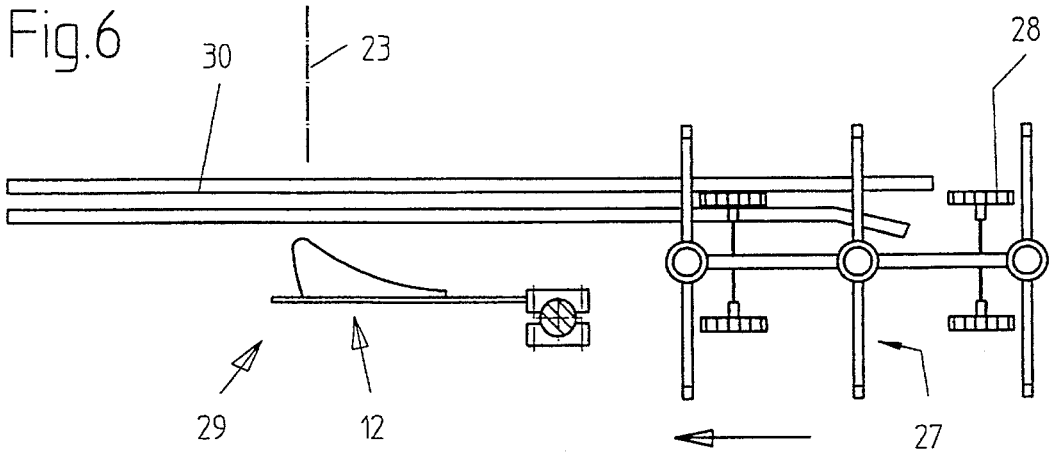
FIG. 6 is a schematic plan view of a package carrier device in the form of a creel truck.

It is evident from FIG. 6 that the invention is not restricted to fixed creel installations. The package carrier device can in fact also be formed as a creel truck equipped with running gear 28 and able to travel from an operating position to another desired position. For package ejection, the creel truck is guided through an ejection station 29 on which the striker arm 12 is arranged. For correct positioning of the creel truck in relation to the striker arm, preferably a rail 30 is provided which causes linear positive guidance of the creel truck. The creel truck is slid manually through the ejection station, the same ejection mechanism being deployed as has already been described in the previous examples.

Inasmuch as the invention is subject to modifications and variations, the foregoing description and accompanying drawings should not be regarded as limiting the invention, which is defined by the following claims and various combinations thereof:

What is claimed is a:

1. Device for ejecting remnant packages or empty bobbins from a creel (1), said device comprising a package carrier device (5) on which numerous spindles (6) are arranged in rows for the accommodation of packages, the package carrier device being able to travel from an operating position (8) for unwinding of the packages into a changing position (9) for reloading of the spindles, a plurality of striker elements, one for each row of spindles, arranged in the area of movement of the package carrier device (5), each said striker element comprising a spring for storing energy, cocking means for storing energy in the spring in response to movement of the package carrier device, trigger means for releasing the spring device so that the striker element imparts a force impulse (I) in the direction of and at a trigger position adjacent one of said spindles (6), to thereby eject a remnant package (2) or empty bobbin therefrom.

2. Device according to claim 1, wherein the striker element is a striker arm (12) fixed on a holder (13).

3. Device according to claim 2, wherein the holder (13) can be fixed in varying angular positions on a holding rod (14) in order to adjust the tension of the spring.

4. Device according to claim 2, wherein the cocking means comprises a cam (16) for tensioning the striker arm as a package carrier device (5) moves past the cam, the shape of the cam receding abruptly at its highest point in relation to its plane of movement in order to release the force impulse in the trigger position.

5. Device according to claim 4, wherein the striker arm comprises a leaf spring (12), with the cam mounted on a side of the leaf spring facing said packages.

6. Device according to claim 1, further comprising an impact disc (19) loosely arranged on each spindle (6), so that the impact disc is struck by the striker element, the force impulse (I) thereby being imparted indirectly onto the remnant package or empty bobbin.

7. Device according to claim 6, wherein the impact disc (19) thickens from its center outwards.

8. Device according to claim 1, wherein the striker element (12) is arranged in such a way that, on reaching the trigger position, the force impulse is delivered below a spindle.

9. Device according to claim 1, further comprising a retrieving device (21) arranged below the lowest spindle in the plane of the trigger position (23), said retrieving device having means for feeding the ejected remnant packages and empty bobbins to a conveyor device (22).

10. Device according to claim 1, wherein the package carrier device comprises vertical package carrier tubes (5) attached to upper and lower horizontal, continuous transport chains (7) and wherein the striker elements are arranged adjacent to chain deflection wheels (10) which lie in the direction of transport between respective spans of the chains, said spans corresponding to the operating position (8) and the change position (9).

11. Device according to claim 1, wherein the package carrier device comprises horizontal package support tubes which are attached to lateral, vertical, continuous transport chains.

12. Device according to claim 1, wherein the package carrier device is a traveling creel truck and the striker element is arranged at an ejection station which is fixed and which said creel truck must pass in order to reach a change station.

* * * * *